United States Patent [19]

Norimoto et al.

[11] Patent Number: 4,469,156

[45] Date of Patent: Sep. 4, 1984

[54] METHOD AND APPARATUS FOR SHAPING WOOD MATERIAL INTO A PREDETERMINED CONFIGURATION

[76] Inventors: Misato Norimoto, 140, Matsukage-cho, Marutamachi Agaru, Teramachidori, Kamigyo-ku; Kenji Hasegawa, 4-44, Kitasakurazuka 3-chome, Toyonaka-shi, Osaka-fu, both of Japan

[21] Appl. No.: 186,656

[22] Filed: Sep. 12, 1980

[51] Int. Cl.[3] ..... B27M 1/00

[52] U.S. Cl. ..... 144/380; 34/13.8; 144/254; 144/270

[58] Field of Search ..... 144/327, 254, 317, 259, 144/270, 271, 380, 381; 34/4, 13.4, 13.8

[56] References Cited

U.S. PATENT DOCUMENTS

| | | | |
|---|---|---|---|
| 360,848 | 4/1887 | Bond | 144/381 |
| 1,795,475 | 3/1931 | Choy | 144/259 |
| 2,973,793 | 3/1961 | Irvine | 144/380 |
| 3,003,204 | 10/1961 | Bryant | 144/364 |
| 3,063,483 | 11/1962 | Shumacher | 144/254 X |
| 3,107,708 | 10/1963 | Savage | 144/259 |
| 4,148,346 | 4/1979 | Scarnecchia | 144/1 C |
| 4,259,560 | 3/1981 | Rhodes | 34/4 |
| 4,273,950 | 6/1981 | Chitre | 34/4 |

*Primary Examiner*—W. D. Bray

*Attorney, Agent, or Firm*—Birch, Stewart, Kolasch & Birch

[57] ABSTRACT

A method and apparatus for shaping wood materials into a predetermined configuration wherein the wood material is substantially saturated with water, heated, shaped and dried, and wherein microwave energy is used for at least the heating stage of the method.

15 Claims, 3 Drawing Figures

METHOD AND APPARATUS FOR SHAPING WOOD MATERIAL INTO A PREDETERMINED CONFIGURATION

BACKGROUND OF THE INVENTION

The present invention relates to a method and apparatus for shaping timbers, wood material, and the like, and more particularly, to a method and apparatus for shaping timbers or wood material such as plywoods, composite wood materials, L.V.L., particle boards, fiberboards or the like into a predetermined configuration, wherein wetted-out or water-saturated timber or wood is simultaneously bent and dried through the application of microwave irradiation thereto.

In a process for drying wetted-out or water saturated timbers or wood material, or more specifically, wood material in a water saturated state which is beyond the equilibrium moisture content thereof, the wood shows a relatively high plasticity. Accordingly, when such wood material is placed under load, it will exhibit high creep deformations in the direction of the load. In addition, when such wood material is subsequently unloaded, upon completion of the drying process, a relatively large residual and premanent deformation remains. Furthermore, such creep deformation as that which is effected under the conditions of simultaneous heat and moisture transfer is relatively large when compared with that obtained under a constant temperature condition. The phenominal facts as described hereinabove have been already confirmed through experimental and/or theoretical study, and accordingly, much attention has been paid to such relevant, rheological characteristics of wood materials with considerable efforts being undertaken to develop their useful applications.

SUMMARY OF THE INVENTION

Accordingly, an essential object of the present invention is to provide a method for providing timbers or wood materials with plastic deformations of bending, which takes advantage of such rheological characteristics of wood materials as described hereinabove.

Another important object of the present invention is to provide a method as described above, which can be accomplished in a relatively simple manner without requiring any time-consuming steps therein.

A still further object of the present invention is to provide a method as described above, which does not require any expensive appliances for the execution of the method, and thus can be accomplished at low cost.

To accomplish these and other objects according to the present invention, there is provided a method for shaping timbers or wood materials into a predetermined shape which comprises the sequential steps of substantially saturating the wood material with water, heating the wood material up to a predetermined temperature through the application of microwave irradiation thereonto, deforming the wood material into said predetermined shape, and drying the wood material, thereby obtaining the desired wood product. The deforming step as described above is executed either during the application of the microwave irradiation to the wood material or after the application of the microwave irradiation to the wood material has been completed. Furthermore, depending upon necessity, the deformed wood material can be dried through the further application of microwave irradiation thereto, while the deformation effected in the deforming step is maintained unchanged.

The apparatus used in performing the method of the present invention comprises a microwave irradiation room equipped with at least one microwave generator; a metallic supporting bed disposed inside the microwave irradiation room and provided with a pair of upwardly extending wall portions, so that a water saturated or wetted-out item of wood can be suspended therebetween; a strap board made of Teflon (a trade name of a specific copolymer produced by Du Pont Co., Ltd.) or a metallic material, which is placed on the central portion of the suspended wood material; at least one metallic weight extending from the longitudinal center of the suspended wood material, with the string portion of the metallic weight being wrapped around the central portion of the strap board, causing the wood material to be maintained in a loaded condition; and a metallic block disposed beneath the metallic weight and covered with a Teflon member, the height of said block being arranged in a manner such that when a predetermined amount of creep deformation of the wood material is achieved further deformation of the wood material is prevented.

As is clear from the description hereinabove, the present method and apparatus makes it possible to provide the wood material with desired deformations and/or bending by taking advantage of the rheological characteristics of wood materials together with microwave heating, which is characterized by its high energy efficiency. As a result, when compared with a conventional method for deforming or shaping wood materials using the steaming method, the present method can be much more easily and efficiently accomplished. Furthermore, since the present method makes it possible to continuously heat the wood material through the use of microwave irradiation, even after the predetermined deformation or bending of the wood material has been completed, the respective bending and drying steps of the wood material are simultaneously accomplished in an effective manner. Moreover, the apparatus of the present invention can be provided with very little expense. Accordingly, the present invention can be accomplished at very low cost.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
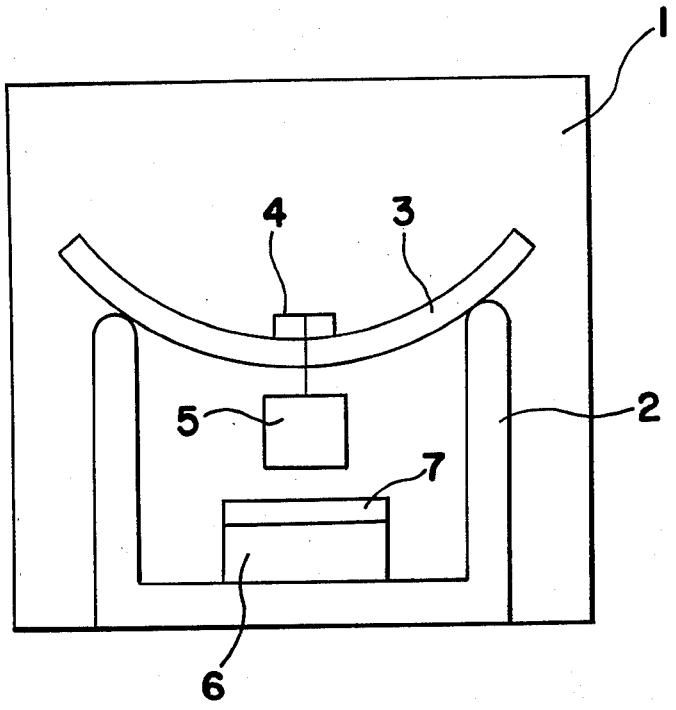
FIG. 1 is a schematic, side view of one preferred embodiment exemplifying the method and apparatus for providing wood with specific deformations or bending according to the present invention. The side covering of the chamber has been removed for clarity.

As far as timbers and wood material are concerned, the glass transition temperatures of lignin, hemicellulose, and cellulose, each being a substantial constituent of wood materials are in the temperature ranges of 134° to 235° C., 167° to 217° C., and 231° to 253° C., respectively. On the other hand, under a wetted-out, saturated condition, these temperatures are in the ranges of 77° to 108° C., 54° to 142° C., and 222° to 250° C., respectively. Therefore, when the temperature of the wood material is raised above 54° C. when in a wetted-out condition, hemicellulose molecules begin the micro Brownian movement in accordance with the movement of water molecules, with the result that the plastication of the wood material is first effected. Furthermore, when the temperature of the wood material is further increased higher than a temperature of 100° C., the micro Brownian movement relating to lignin and hemicellulose becomes distinct, with the result that the creep deformation of the wood material can correspondingly become large.

In short, when the temperature of the wood material in the wetted-out state is increased to a temperature higher than 54° C., the plastication of the wood material begins to proceed in accordance with the distinct effect of the micro Brownian movement of hemicellulose. In accordance with the change of the water content with the increase of the temperature from 100° to 150° C., the micro Brownian movement relating to lignin and hemicellulose becomes much distinct. Such being the case, the creep deformation of the wood material becomes distinct. In particular, as far as the wood material is concerned, the concentration of lignin is especially high in respective boundary portions of neighboring cells. Accordingly, since dislocation or relative slippage between the neighboring cells takes place quite easily, such dislocations are effected very frequently.

When the dielectric materials such as wood, and the like are treated through the application of high output microwave irradiation, the heat evolution of these materials is also effected as can be seen in the case of the high-frequency electric heating. More specifically, even in the case of high output microwave irradiation, the heat evolution of the dielectric materials is effected through the occurrence of the phase difference between the consequent electric field induced by the polarization of the dielectric material and the electric field specified by the electromagnetic wave. As is well known to those skilled in the art, the rate of heat rise is proportional to both the dielectric loss factor and the frequency of the electromagnetic wave, subject to the condition that the strength of the electric field is maintained in a constant state. As for wood in its wetted-out or water saturated state, such a specific frequency which will provide the locally maximum value of the dielectric loss factor exists in the microwave region. Thus, the products of the dielectric loss factor and the frequency substantially tend to become extremely large in the microwave region, when compared with that effected in the high-frequency wave region. This corresponds to the fact that heating with high energy efficiency can be substantially effected through microwave irradiation. Accordingly, with the use of microwave irradiation heating, since the heat evolution is efficiently carried out, the simultaneous plastication and drying of the wood material can be achieved within a very short period of time through simultaneous, rapid moisture transfer and temperature elevation.

Contrary to the thermodrying method, the moisture content distribution characteristics according to the microwave irradiation heating method are reversed. That is, the moisture content distribution of wood tends to increase towards the respective boundaries and extremities thereof. When microwave energy of a high electrical power output is irradiated upon the wetted-out or water saturated wood material, the temperature of the wood material is increased in a very short time to a temperature higher than the respective softening temperatures of lignin and hemicellulose. Such being the case, in accordance with the elevation of the temperature, the water contained inside the wood material is vaporized, and the consequent vapor produced thereby is forcibly and rapidly transferred towards the outside as a result of the rise in the internal pressure, which result in the above described vaporization of the water. Thus, accordingly, the drying process of the wood stuff is executed. During the drying process as described above, if the wood material is loaded, the wood material can be easily deformed and shaped. In particular, so far as the deformations or bending are concerned, the deformation of respective boundary and extremities of the wood material become very distinct, since the maximum stress is usually distributed at and around such boundary and extremities because of relatively higher moisture content distribution thereat. Such bending characteristics with respect to wetted-out or water saturated wood material through the application of microwave irradiation, as described above, are in principle used for the bending of wood material according to the present invention, and is specified hereinbelow as a method for providing timbers and wood material with deformations having a predetermined configuration.

Referring now to FIG. 1, there is shown one preferred embodiment exemplifying the method of the present invention. The timber or the wood material 3 being in a wetted-out or water saturated state is supported approximately at its longitudinal ends with respective ends of wall portions of a metallic supporting bed 2 which is disposed inside a microwave irradiation room 1. The microwave irradiation room 1 is equipped with at least one microwave generating means (not shown) containing high output power. After the wood 3 has been suspended over the wall portions, a strap board 4 made of Teflon (a trade name of a specific copolymer produced by Du Pont Co., Ltd.) or a metallic material is placed on the longitudinal central portion of the suspended wood material 3. At least one metallic weight 5 is hung down from the longitudinal center of the spanned wood stuff 3, with the string portion of the metallic weight 5 being transversely positioned around the central portion of the strap board 4, thereby placing the wood material in a loaded condition. There is further provided a metallic block 6, the top portion of which is covered with a member 7 made of Teflon. The height of the metallic block 6 is arranged, so that when a predetermined creep deformation of the wood is achieved, further deformation or bending is prevented. According to the present invention, after placing the wood material in a loaded state as described above, the wood material is treated with microwave irradiation, thereby causing creep deformation or bending. Furthermore, when a predetermined amount of creep deformation or bending of the wood is prevented by the metallic block 6 which is covered by the member 7 made of Teflon, and thus the simultaneous drying and bending of the wood are completed.

By way of example, when a wood board 2 cm×2 cm×70 cm (a span of 60 cm), with an initial moisture content of approximately 120% is treated with microwave irradiation having a frequency of 2,450 MHz and an electrical output capacity of 200 V and 2.4 KW, the wood material 3 is dried to an average moisture content of approximately 5% within approximately ten minutes. With respect to the deflection of the wood stuff described above, an amount of deflection of approximately 5 to 6 cm can be produced with a relatively small load, which is equivalent to approximately 30% of the breaking load when bending water saturated wood, subject to the condition that the initial span of the wood material is set at 60 cm. As is clear from the description in the foregoing, a variety of deformations can be achieved if the dimensions of the metallic supporting bed 2 and the amount of the weight 5 are appropriately varied.

Figure 2:
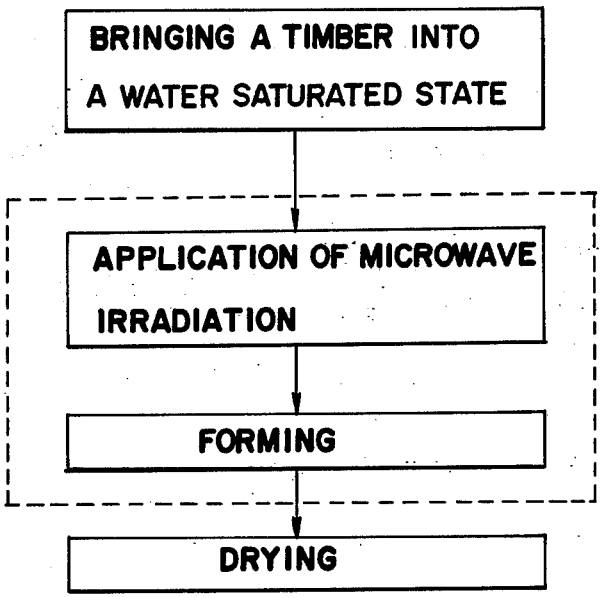
FIG. 2 is a diagram showing the method for providing wood material with deformations or bending according to the present invention.

According to the present invention, the method for providing timbers or the wood with deformations or bending can be performed through the process steps shown in FIG. 2. The water is first introduced into the wood stuff. The wetted-out wood stuff is then successively treated through the application of the microwave irradiation. After having been treated through the application of the microwave irradiation, the wood material is subsequently formed into a predetermined shape or construction. As described hereinabove, the step of applying the microwave irradiation and the step of forming, as described above, can be simultaneously executed according to the present invention. After the forming step has been completed, the step for further drying is accomplished through further application of microwave irradiation. Consequently, if necessary, the application of microwave irradiation can be executed in a two-stage manner, as described hereinbelow.

In a case where a relatively large deformation is required, the wetted-out wood material is treated with an application of microwave irradiation under an unloaded condition in the microwave irradiation room 1. Such an application of microwave irradiation as described above is continued, until the vaporization of the water from the wood becomes distinct, with the temperature of the wood being higher than 100° C. Once the wood is placed in the above state, as described above, the wood is taken out of the microwave irradiation room 1, and then formed into an initial staged predetermined configuration with preliminary jigs in a prompt manner. The wood material containing its initial stage configuration is again placed into the microwave irradiation room 1, and then, is further treated with microwave irradiation. When the temperature of the wood material again reaches a temperature more than that as described above, the wood is again taken out of the microwave irradiation room 1 and all the form retaining jigs are taken away. The preliminarily formed wood can be further formed with other kinds of jigs in a prompt manner. The wood containing a final configuration is again placed into the microwave irradiation room 1 and is left in a microwave heating condition until the moisture content of the wood attains its final moisture content. After having been treated in such a manner as described above, the simultaneous bending and drying process of the wood is completed.

Figure 3:
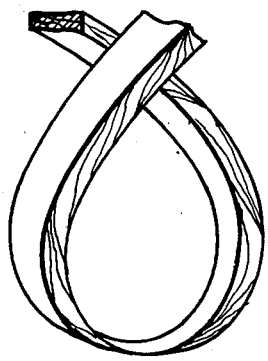
FIG. 3 is an example of a final product of wood material which is obtained through the process shown in FIG. 2.

By way of example, a wetted-out timber of 1 cm×2 cm×70 cm can be easily, simultaneously bent and dried to provide a product shaped in a profile having a radius of curvature of approximately 5 cm within several minutes. Furthermore, referring now to FIG. 3, there is shown one final product of wood material which is obtained through the process including the above described steps according to the present invention. As is clear from the product as shown in FIG. 3, the present method can provide wood materials with very complicated configurations. For example, this final product is ready for leg portion of a table. Furthermore, in addition to a bending operation, the present method is, of course, capable of being employed to reform specific deformations of wood material into its stretched state.

According to the other modified embodiments of the present invention, the wood stuff is bent or deformed subsequent to the step of heating the wood above a predetermined temperature (i.e. higher than 54° C., preferably higher than 100° C.). The subsequent drying step is, however, performed through a hot-air drying method or the like, instead of the microwave heating method.

As is clear from the description in the foregoing, the present method makes it possible to effect the deformation or bending of wood materials by taking advantage of the rheological characteristics of the wood material in which microwave heating, which is characterized by its high energy efficiency is effectively used for this purpose. As a result, when compared with conventional methods for deformation or bending utilizing the steaming method, the method of the present invention for shaping wood or bending wood can be easily and efficiently accomplished. Furthermore, since the present method makes it possible to continuously heat the wood through the microwave irradiation method even after the predetermined deformations or bending of the wood being accomplished, the respective bending and drying steps of the wood are simultaneously accomplished in quite a handy manner.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for shaping a wood material into a predetermined configuration which comprises the steps of bringing the wood material into a substantially water saturated state;

heating the water saturated wood material to a predetermined temperature;

deforming the wood material into said predetermined configuration, and drying the wood material, wherein the heating of the water saturated wood material is accomplished through the use of microwave energy.

2. The method of claim 1 wherein the drying of the wood material is accomplished through the use of hot air.

3. The method of claim 1 wherein the heating of the wood material with microwave energy is continued during the deforming of the wood material.

4. The method of claim 1 or 3 wherein the drying of the wood material is accomplished through the use of microwave energy.

5. The method of claim 1 wherein the deforming and drying is carried on simultaneously.

6. The method of claim 1 wherein the wood material is heated to a temperature of above 54° C.

7. The method of claim 1 wherein the wood material is heated to a temperature of above 100° C.

8. The method of claim 1 wherein the wood material has a water content of about 120% by weight.

9. The method of claim 1 wherein the wood material is dried to a water content of about 5% by weight.

10. An apparatus for shaping a wood material into a predetermined configuration which comprises a chamber, microwave generating means operatively associated with said chamber for heating the wood material, means disposed within said chamber for supporting the wood material to be deformed, means for bending the wood material into said predetermined or deformed shape, and means for drying the wood material.

11. The apparatus of claim 10 wherein the microwave generating means also functions as the drying means.

12. The apparatus of claim 10 wherein the drying means is a hot-air drying device.

13. The apparatus of claim 10 wherein the wood supporting means comprises a pair of upwardly extending members across which the wood material is suspended.

14. The apparatus of claim 13 wherein the bending means is a weight suspended from the wood material.

15. The apparatus of claim 14 wherein a stop means is dispersed below the bending means for limiting the extent of the bending.

* * * * *